US011006732B2

(12) United States Patent
Solano

(10) Patent No.: US 11,006,732 B2
(45) Date of Patent: May 18, 2021

(54) MAKEUP MIXING PLATE AND COVER

(71) Applicant: Ashley Jessica Solano, Los Angeles, CA (US)

(72) Inventor: Ashley Jessica Solano, Los Angeles, CA (US)

( * ) Notice: Subject to any disclaimer, the term of this patent is extended or adjusted under 35 U.S.C. 154(b) by 153 days.

(21) Appl. No.: 15/975,708

(22) Filed: May 9, 2018

(65) Prior Publication Data

US 2018/0325240 A1 Nov. 15, 2018

Related U.S. Application Data

(60) Provisional application No. 62/503,799, filed on May 9, 2017.

(51) Int. Cl.
*A45D 40/22* (2006.01)
*A45D 40/24* (2006.01)
*A45D 44/00* (2006.01)

(52) U.S. Cl.
CPC ..... *A45D 40/222* (2013.01); *A45D 40/24* (2013.01); *A45D 44/00* (2013.01)

(58) Field of Classification Search
CPC ..... A45D 40/222; A45D 40/24; A45D 44/00
USPC ..... 220/230; 132/314; 206/1.8, 581, 823
See application file for complete search history.

(56) References Cited

U.S. PATENT DOCUMENTS 4,488,645 A * 12/1984 Yamaguchi ..... G11B 23/02 206/307.1
2011/0253167 A1* 10/2011 Shteysel ..... A45D 40/24 132/314
2012/0154994 A1* 6/2012 Lambert ..... A45D 40/222 361/679.01
2013/0133686 A1* 5/2013 Shteysel ..... A45D 40/24 132/314
2014/0138378 A1* 5/2014 Lequeux ..... A45C 13/1069 220/23.83
2014/0326273 A1* 11/2014 Kalyanpur ..... A45D 40/24 132/314
2019/0110578 A1* 4/2019 Maurin ..... A45D 40/221

* cited by examiner

*Primary Examiner* — James N Smalley
*Assistant Examiner* — Madison L Poos
(74) *Attorney, Agent, or Firm* — Stephen Hallberg

(57) ABSTRACT

A makeup mixing plate and cover product is configured to open and close over a makeup plate to protect and maintain makeup items used intermittently over a duration of time. The makeup mixing plate and cover product includes a makeup plate base and a makeup plate lid that is configured to cover a makeup mixing plate that a makeup artist uses as a workspace while applying makeup to a makeup recipient. The makeup mixing plate and cover product includes several magnets that are attached to the makeup plate base and the makeup plate lid to magnetically connect the makeup plate lid to the makeup plate base in a closed configuration of the makeup mixing plate and cover product, the magnets being disconnected to an open configuration of the makeup mixing plate and cover product.

10 Claims, 9 Drawing Sheets

MAKEUP MIXING PLATE AND COVER

CLAIM OF BENEFIT TO PRIOR APPLICATION

This application claims benefit to U.S. Provisional Patent Application 62/503,799, entitled "MAKEUP MIXING PLATE AND COVER," filed May 9, 2017. The U.S. Provisional Patent Application 62/503,799 is incorporated herein by reference.

BACKGROUND

The embodiments herein relate generally to covers that protect and maintain makeup items used intermittently over a duration of time and, more specifically, to a makeup mixing plate and cover that protects and maintains makeup items used intermittently over a duration of time.

In the makeup industry, people who apply makeup (hereinafter referred to in the singular as "makeup artist" or "makeup professional" and in the plural as "makeup artists" or "makeup professionals") use makeup plates to hold and mix makeup to apply to actors or models. The makeup plates typically are steel plates, but some makeup artists use plastic makeup plates while applying makeup to an actor or a model.

Conventional makeup plates typically are exposed above the plate, allowing makeup artists to hold the makeup plate with one hand, while applying makeup from the makeup plate to the artist/model with their other hand. Typically, there are is left over makeup on the makeup plate after the makeup artist has applied makeup to the artist or model. This often leaves the left over makeup exposed to air, dust, wind, and other surrounding elements, which renders the left over makeup unsuitable for further applications to the artist/model. Thus, many makeup artists add new makeup to the makeup plate each time they need to apply makeup to an artist or model. As a result, many makeup artists dispose of the unused makeup on the makeup plate. This is wasteful and results in greater costs.

Therefore, what is needed is a way to protect makeup on a makeup plate from environmental elements when makeup artists are not engaged in applying makeup to an individual, thereby ensuring that makeup left over on the makeup plate remains relatively fresh and free from contaminants and other elements in the ambient surroundings during the time between applications of the makeup to the individual.

BRIEF DESCRIPTION

A makeup mixing plate and cover product is configured to open and close over a makeup plate to protect and maintain makeup items used intermittently over a duration of time. The makeup mixing plate and cover product includes a makeup plate base and a makeup plate lid that is configured to cover a makeup mixing plate that a makeup artist uses as a workspace while applying makeup to a makeup recipient. A makeup recipient can be any person or subject, such as an actor, a model, etc. In some embodiments, the makeup mixing plate and cover product includes a plurality of magnets that are attached to the makeup plate base and the makeup plate lid to magnetically connect the makeup plate lib to the makeup plate base in a closed configuration of the makeup mixing plate and cover product. In some embodiments, the plurality of magnets includes a pair of base magnets attached to a pair of base corners of the makeup plate base along an opening edge of the makeup mixing plate and cover product. In some embodiments, the plurality of magnets includes a pair of lid magnets attached to a pair of lid corners of the makeup plate base along the opening edge of the makeup mixing plate and cover product. In some embodiments, the makeup plate lid is attached to the makeup plate base along a bending edge of the makeup mixing plate and cover product.

In some embodiments, the makeup plate lid is a trapezoid shaped lid with an open space in the middle of the lid and four side walls that cover over the makeup mixing plate down to the makeup plate base when the makeup mixing plate and cover product is in the closed configuration. In some embodiments, the trapezoid shaped lid includes a pair of long frame sides and a pair of short frame sides. In some embodiments, a clear cover attaches to an underside of the pair of long frame sides the pair of short frame sides. In some embodiments, the clear cover is a plexiglass plate that is glued under the makeup plate lid to cover the open space in the middle of the makeup plate lid. In some embodiments, the makeup plate lid and the makeup plate base are constructed from at least one of acrylic and cardboard.

In some embodiments, a compact makeup mixing plate and cover product is configured to open and close over a compact makeup plate to protect and maintain a reduced number of makeup items that are used intermittently over the duration of time. In some embodiments, the reduced number of makeup items are associated with a particular type of makeup product. In some embodiments, the particular type of makeup product includes lipstick and the reduced number of makeup items includes a lipstick makeup item and a chapstick makeup item.

The preceding Summary is intended to serve as a brief introduction to some embodiments of the invention. It is not meant to be an introduction or overview of all inventive subject matter disclosed in this specification. The Detailed Description that follows and the Drawings that are referred to in the Detailed Description will further describe the embodiments described in the Summary as well as other embodiments. Accordingly, to understand all the embodiments described by this document, a full review of the Summary, Detailed Description, and Drawings is needed. Moreover, the claimed subject matters are not to be limited by the illustrative details in the Summary, Detailed Description, and Drawings, but rather are to be defined by the appended claims, because the claimed subject matter can be embodied in other specific forms without departing from the spirit of the subject matter.

BRIEF DESCRIPTION OF THE DRAWINGS

The detailed description of some embodiments of the invention is made below with reference to the accompanying figures, wherein like numerals represent corresponding parts of the figures.

DETAILED DESCRIPTION OF CERTAIN EMBODIMENTS

In the following detailed description of the invention, numerous details, examples, and embodiments of the invention are described. However, it will be clear and apparent to one skilled in the art that the invention is not limited to the embodiments set forth and that the invention can be adapted in many ways without affecting the overall function of the invention.

Figure 1:
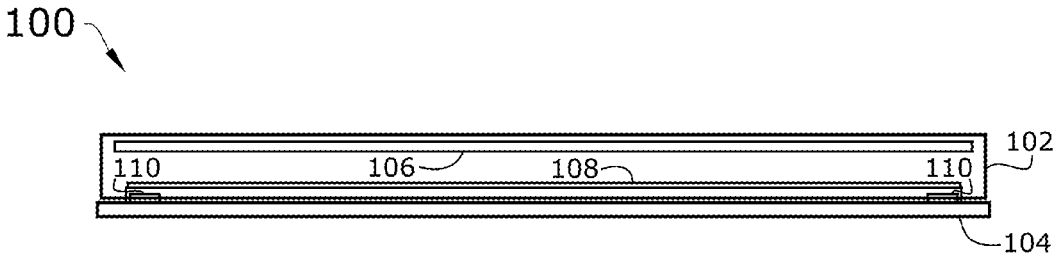
FIG. 1 conceptually illustrates a front view of a makeup mixing plate and cover product in a closed configuration with a makeup plate lid closed to cover a makeup mixing plate in at least a first embodiment.
Figure 2:
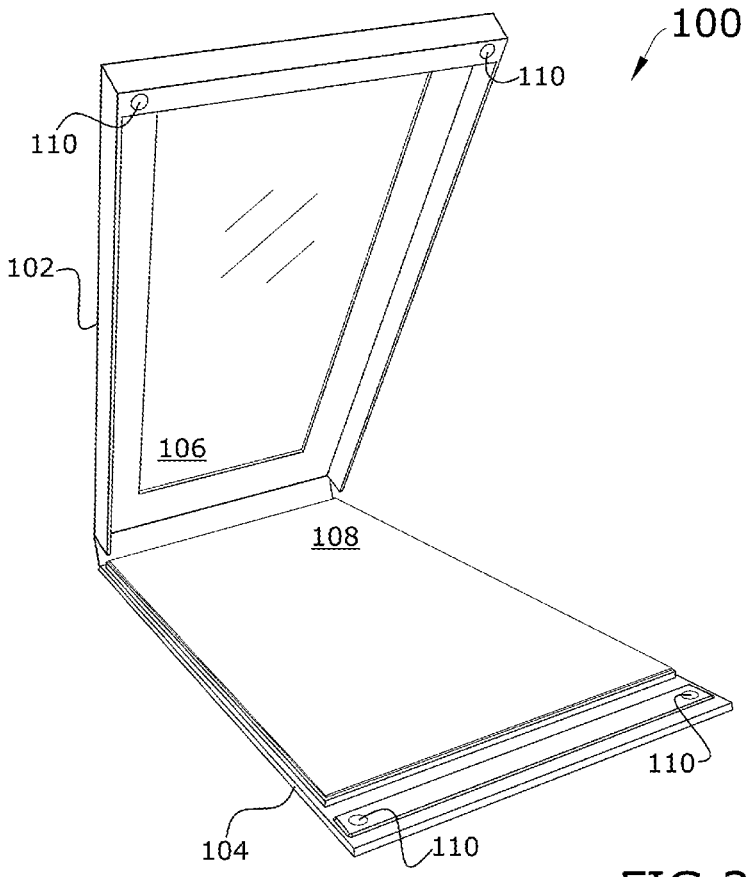
FIG. 2 conceptually illustrates a perspective view of the makeup mixing plate and cover product in an open configuration with the makeup plate lid opened to expose the makeup mixing plate in at least the first embodiment.

By way of example, and referring to FIG. 1 and FIG. 2, one embodiment of the makeup mixing plate and cover product 100 comprises makeup plate lid 102, makeup plate base 104, glass 106, makeup mixing plate 108, and magnets 110. Makeup plate lid 102 is configured to cover makeup mixing plate 108. Magnets 110 provide a strong connection with the makeup plate base 104 to close the makeup plate lid 102 over the makeup mixing plate 108. Glass 106 is attached to the underside of the makeup plate lid 102 to cover the open space in the middle of the lid 102 and provide visibility to the makeup mixing plate 108 and any makeup items present on, in, and around the makeup mixing plate 108.

First turning to FIG. 1, which conceptually illustrates a front view of the makeup mixing plate and cover product 100 in a closed configuration with the makeup plate lid 102 closed to cover the makeup mixing plate 108. As demonstrated in this figure, the makeup mixing plate and cover product 100 is in a closed position. Specifically, the makeup plate lid 102 lays directly over the makeup mixing plate 108 and is closed to nearly direct connection with the makeup plate base 104, with the magnets 110 securing the connection of the makeup plate lid 102 to the makeup plate base 104 along the opening edge of the makeup mixing plate and cover product 100.

The makeup mixing plate and cover product 100 is manufactured to be used by makeup artists with different sizes of hands. Examples of manufacturing sizes include, without limitation, small, medium, and large. Regardless of the size of the makeup mixing plate and cover product 100, the dimensions of the makeup plate lid 102 and makeup plate base 104 are approximately 4:1 ratio. In a preferred embodiment, the makeup mixing plate and cover product 100 is manufactured with dimensions of 2 mm height (or thickness) for the makeup plate base 104 and 8 mm height for the makeup plate lid 102. A person of ordinary skill in the art would appreciate that other manufacturing dimensions can be suitable for the makeup mixing plate and cover product 100, so long as a makeup artist is able to hold the makeup mixing plate and cover product 100 in one hand while applying makeup to a makeup recipient with the other hand.

Reference is now made to FIG. 2, which conceptually illustrates a perspective view of the makeup mixing plate and cover product 100 in an open configuration with the makeup plate lid 102 opened to expose the makeup mixing plate 108. As demonstrated in this figure, the makeup mixing plate and cover product 100 is in an open position. In particular, the makeup plate lid 102 is engaged along the opening edge and pulled up to open the makeup mixing plate and cover product 100 and expose the makeup mixing plate 108 to the makeup artist. Various makeup items may be present on the makeup mixing plate 108 if the makeup artist is already performing makeup applications to a makeup recipient during a makeup session. For example, a film shoot may be ongoing for several hours and the makeup artist may be using the makeup mixing plate and cover product 100 to mix and maintain several makeup items being applied intermittently to a particular actor for an extended period of time during the film shoot. Thus, when the makeup artist needs to apply makeup to the particular actor, the makeup plate lid 102 is opened along the opening edge. A slight force of the makeup artist's hand releases the makeup plate lid 102 from the magnetically connected makeup plate base 104, thereby allowing the makeup artist to continue working with the makeup items already in use for that particular actor.

Figure 3:
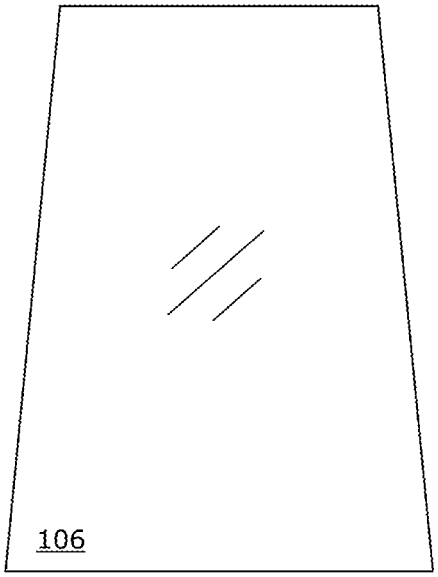
FIG. 3 conceptually illustrates a top perspective view of a plexiglass cutout provides transparent views of the makeup mixing plate when the makeup plate lid is closed in at least the first embodiment.

In some embodiments, the makeup mixing plate and cover product 100 includes a transparent open space in the middle of the makeup plate lid 102 for visibility of the makeup mixing plate 108 when the makeup mixing plate and cover product 100 is in the closed configuration. By way of example, FIG. 3 conceptually illustrates a top perspective view of a plexiglass cutout provides transparent views of the makeup mixing plate when the makeup plate lid is closed, while FIG. 4 conceptually illustrates a top perspective view of the makeup plate lid with the open space of the lid covered by the plexiglass cutout. As demonstrated in this figures, the glass 106 is a transparent plexiglass cutout in some embodiments of the makeup mixing plate and cover product 100. Other types of transparent materials are used in other embodiments. Another example of a transparent material for the glass 30 includes (without limitation) tempered glass. As demonstrated in FIG. 3 and FIG. 4, the glass (plexiglass) 30 allows visibility of the makeup mixing plate 108 and any makeup items present on the plate 108 when the makeup mixing plate and cover product 100 is in the closed position.

Figure 4:
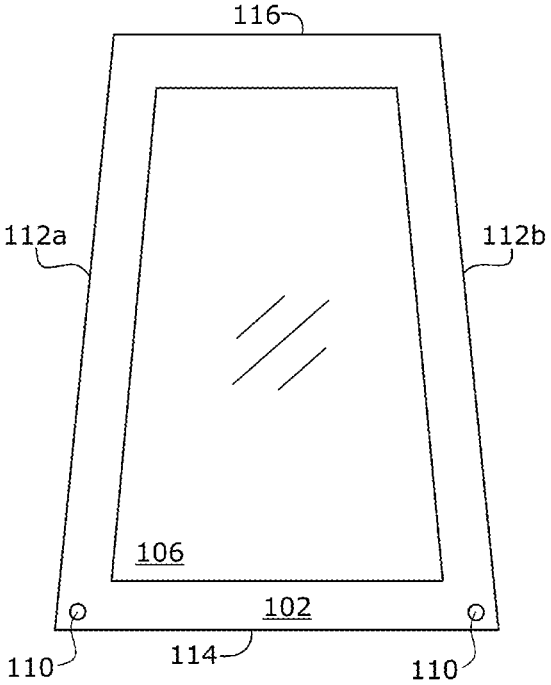
FIG. 4 conceptually illustrates a top perspective view of the makeup plate lid with the open space of the lid covered by the plexiglass cutout in at least the first embodiment.

Also, FIG. 4 conceptually illustrates a top perspective view of the makeup plate lid 102 with the open space of the lid 102 covered by the glass 30 (plexiglass cutout). As shown in this figure, the makeup mixing plate and cover product 100 has a trapezoid shape with two long-side edges 112*a* and 112*b* of equal length (e.g., 158 mm), an opening-side edge 114 that is proximate to the magnets 110 (e.g., measuring 115 mm), and a bending-side (or back-side) edge 116 (e.g., measuring 84 mm). The makeup plate lid 102 in this example also shows the opening space in the middle covered by the glass 106 (e.g., plexiglass). The glass 106 (e.g., plexiglass) attaches to the underside of the makeup plate lid 102 along edges of small height (e.g., 13 mm).

Figure 5:
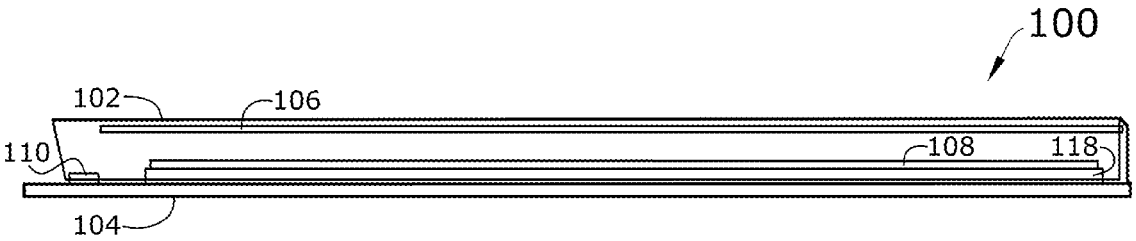
FIG. 5 conceptually illustrates a side perspective view of the makeup mixing plate and cover product in the closed position in at least the first embodiment.

FIG. 5 conceptually illustrates a side perspective view of the makeup mixing plate and cover product 100 in the closed position. As shown in this figure, the total height (from the side view) of the makeup mixing plate and cover product 100 is much smaller than its length. In at least one embodiment, the height from the bottom surface of the makeup plate base 104 to the top surface of the makeup plate lid 102 is 11 mm. As noted above by reference to FIG. 1, the height of the makeup plate lid 102 in some embodiments measures 8 mm while the height of the makeup plate base 104 measures 2 mm (i.e., a 4:1 ratio, with actual measurements based on the size of the makeup mixing plate and cover product 100 in question—either, e.g., small, medium, or large). A gap of 1 mm is present at the connection points of the magnets 110 for the makeup plate lid 102 and the makeup plate base 104. Additionally, in at least one embodiment, the makeup plate lid 102 overhangs the magnets 110 attached to the makeup plate base 104, resulting in an angular displacement of approximately seventy-seven degrees.

Also shown in FIG. 5 is glass 106, which can be plexiglass, tempered glass, or another transparent (or translucent) material that covers an open space in the makeup plate lid 102 of some embodiments. The glass 106 is illustrated in this example as floating only to provide clarity to the drawings. In practice, the glass 106 is attached to the makeup plate lid 106.

In some embodiments, the makeup mixing plate 108 is positioned on an elevated part of the makeup plate base 104 to allow a makeup artist to easily reach makeup on the makeup mixing plate 108 while the makeup mixing plate and cover product 100 is in an open configuration. However, in some embodiments, the makeup mixing plate and cover product 100 further comprises a plate support that provides a surface on which the makeup mixing plate 108 is disposed. As shown in FIG. 5, an example of such a plate support 118 is included in the makeup mixing plate and cover product 100. As visible in the drawings, the plate support 118 provides a surface on which the makeup mixing plate 108 is disposed. In some embodiments, the height of the plate support 118 measures 2 mm and the makeup mixing plate 108 measures 0.5 mm. In some embodiments, the plate support 118 elevates the makeup mixing plate 108 above the makeup plate base 104. The slight elevation provided by the plate support 118 allows a makeup artist to hold the makeup mixing plate and cover product 100 along the edges of the makeup plate base 104 while in the open configuration and easily access makeup present on the makeup mixing plate 108.

Figure 6:
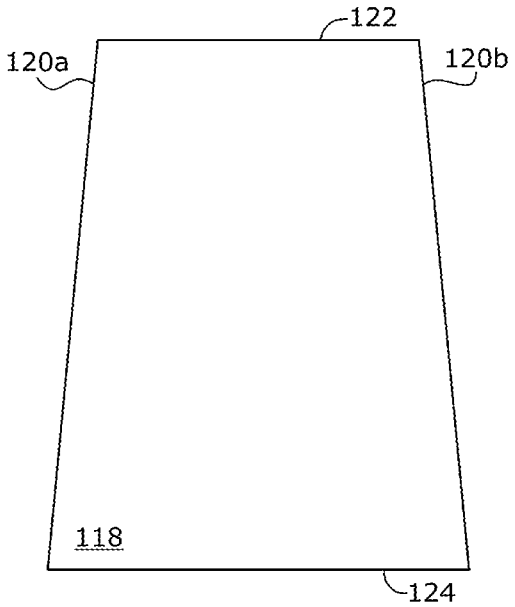
FIG. 6 conceptually illustrates a perspective view of a plate support of the makeup mixing plate and cover product in at least the first embodiment.

Turning now to FIG. 6, which conceptually illustrates the plate support 118 of the makeup mixing plate and cover product 100. In some embodiments, the plate support 118 is made of cardboard and has a trapezoidal shape. As noted above, in some embodiments, the height of the plate support 118 measures 2 mm. In some embodiments, the dimensions of the trapezoidal shape of the plate support 118 are defined by two long plate support edges 120*a* and 120*b* of equal length, a back side plate support edge 122, and an opening side plate support edge 124. In some embodiments, the two long plate support edges 120*a* and 120*b* measure 137 mm each. In some embodiments, the back side plate support edge 122 measures 83 mm. In some embodiments, the opening side plate support edge 124 measures 109 mm.

Figure 7:
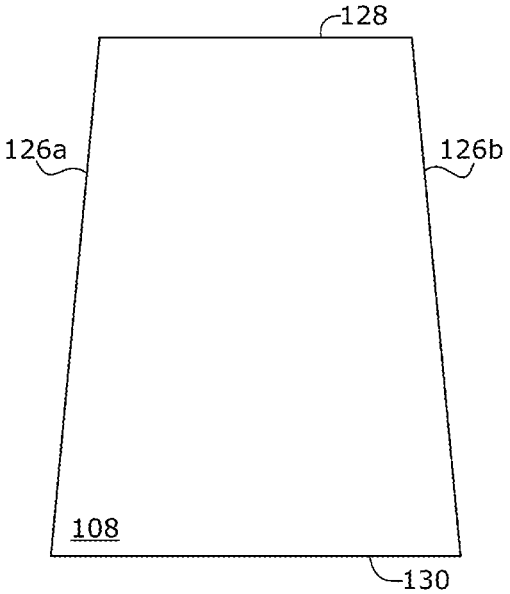
FIG. 7 conceptually illustrates a perspective view of a makeup mixing plate of the makeup mixing plate and cover product in at least the first embodiment.

By way of another example, FIG. 7 conceptually illustrates a perspective view of the makeup mixing plate 108 of the makeup mixing plate and cover product 100. In some embodiments, the makeup mixing plate 108 is made of steel, such as stainless steel, and has a trapezoidal shape. As noted above, in some embodiments, the height of the makeup mixing plate 108 measures 0.5 mm. In some embodiments, the dimensions of the trapezoidal shape of the makeup mixing plate 108 are defined by two long mixing plate edges 126*a* and 126*b* of equal length, a back side mixing plate edge 128, and an opening side mixing plate edge 130. In some embodiments, the two long mixing plate edges 126*a* and 126*b* measure 135 mm each. In some embodiments, the back side mixing plate edge 128 measures 82 mm. In some embodiments, the opening side mixing plate edge 130 measures 107 mm.

Figure 8:
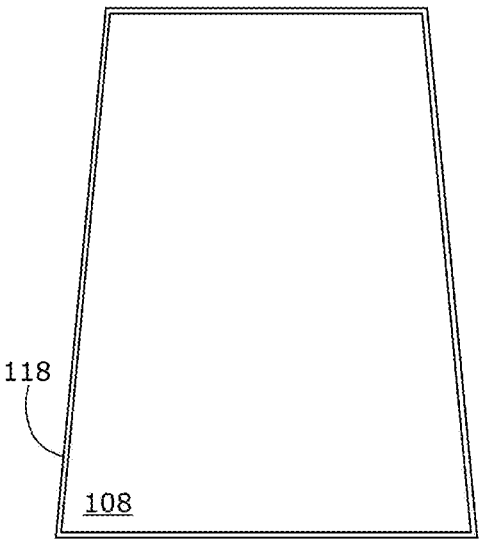
FIG. 8 conceptually illustrates a perspective view of the makeup mixing plate disposed on the plate support of the makeup mixing plate and cover product in at least the first embodiment.

In combination of the two prior examples, FIG. 8 conceptually illustrates a perspective view of the makeup mixing plate 108 disposed on the plate support 118 of the makeup mixing plate and cover product 100.

In the makeup industry people use just the steel plate, or sometimes a plastic palette, or a glossy like paper to mix their makeup products (makeup items like foundation, lipstick, etc.). Embodiments of the makeup mixing plate and cover product described in this specification confers several benefits and improvements over the existing makeup industry options. These benefits and improvements enable makeup artists to overcome many of the problems inherent with the conventional options which presently exist in the makeup industry.

For instance, one of the problems encountered by makeup artists is waste of the makeup items used throughout long work sessions. Some makeup artists clean off all the left over makeup on the makeup palette after a single application to an actor because they do not want to be carrying this palette around all day (e.g., can be twelve hours or more, which in the film industry is not uncommon). In contrast, the makeup mixing plate and cover product described in this disclosure reduces or eliminates makeup waste by keeping makeup items fresh for further use throughout the film shoot (or other work) when the makeup artist is working with a makeup recipient, such as an actor or model. Then, instead of mixing new makeup items for the same actor during the film shoot, the makeup artist can keep the existing mixed makeup products fresh and readily available for touch-ups and re-applications throughout the entire day.

Another problem with the existing options in the makeup industry is that makeup artists are often expected to be fast with touch-ups and re-applications of makeup during a film shoot or between video takes or while a camera operator is changing a lens. The time to apply the touch-up is often minimal, maybe a minute or less if the actor is getting a makeup touch-up between takes. Some makeup artists use glossy paper to overcome this problem. They put makeup items in the glossy paper and then fold it up and put it in their bag to reuse later (attempting to reduce waste). Later, those makeup artists take the glossy paper back out for re-applications and makeup touch-ups. However, the makeup folded in the glossy paper often gets smashed on both sides of the paper. Plus, this existing option often results in makeup artists having to fumble around looking for the glossy paper (or just the makeup items themselves) in a bag or in their pockets. Only after finding the right makeup items can the makeup artist re-mix the makeup on the steel plate, and then apply the makeup to the actor. This is nearly impossible to do timely in some work environments, most notably the film industry where the time between takes is maybe a minute or less. Thus, makeup artists either have to use stale makeup mixtures on open steel plates or palettes, or be lucky to find the right makeup items quickly and mix them at world-record pace, just to be able to keep up with the fast-paced speed of the film industry. Even then, the makeup artist often comes across as unprofessional, with smashed items and disorganized scraps of folded glossy paper, looking tacky and haphazard.

The makeup mixing plate and cover product offers a professional and technical solution to this problem by simply providing opened and closed configurations of the makeup mixing plate and cover product, ensuring the makeup items stay fresh and maintained in the closed configuration and providing easy and fast access to the makeup items via the opened configuration (just flip open the makeup plate lid) the makeup artist may be using throughout the extended work session (e.g., film shoot).

This also has the beneficial effect of reducing or eliminating exposure contamination risk which could impact the integrity of the makeup items in use. For example, the closed configuration of the makeup mixing plate and cover product protects against dust in the air, leaves and natural debris, coffee and other elements of common human use, etc.

Yet another benefit of the makeup mixing plate and cover product described in this specification is that it maintains organization of the work space on the makeup mixing plate. In some scenarios, a makeup artist may be working with two or more actors. In such scenarios, the makeup artist can use one makeup mixing plate and cover product per actor, because each actor may have an array of makeup items which are specifically coordinated to that actor's skin tone, or a type of scene being filmed, etc. In this way, the makeup artist stays organized all day, even when working with different actors who have different makeup requirements.

Another benefit is that the makeup mixing plate and cover product is designed to provide ergonomic comfort and ease of use. The trapezoid shape of the makeup mixing plate and cover product allows a makeup artist to hold the makeup plate base at the short far-side edge, which results in the wider near-side edge being closer to the makeup artist's workable space to apply and mix makeup items. For example, a makeup artist can easily hold the makeup plate base by one hand at the far-side edge.

In addition to the standard sized embodiments of the makeup mixing plate and cover product, some embodiments include a compact makeup mixing plate and cover product. In some embodiments, the compact makeup mixing plate and cover product is configured to open and close over a smaller makeup plate to protect and maintain a reduced number of makeup items that are used intermittently over the duration of time. The reduced number of makeup items may include, for example, lipstick and chapstick, or foundation and eye shadow, etc.

Additional embodiments of the makeup mixing plate and cover product are described next, by reference to FIGS. 9-18.

Figure 9:
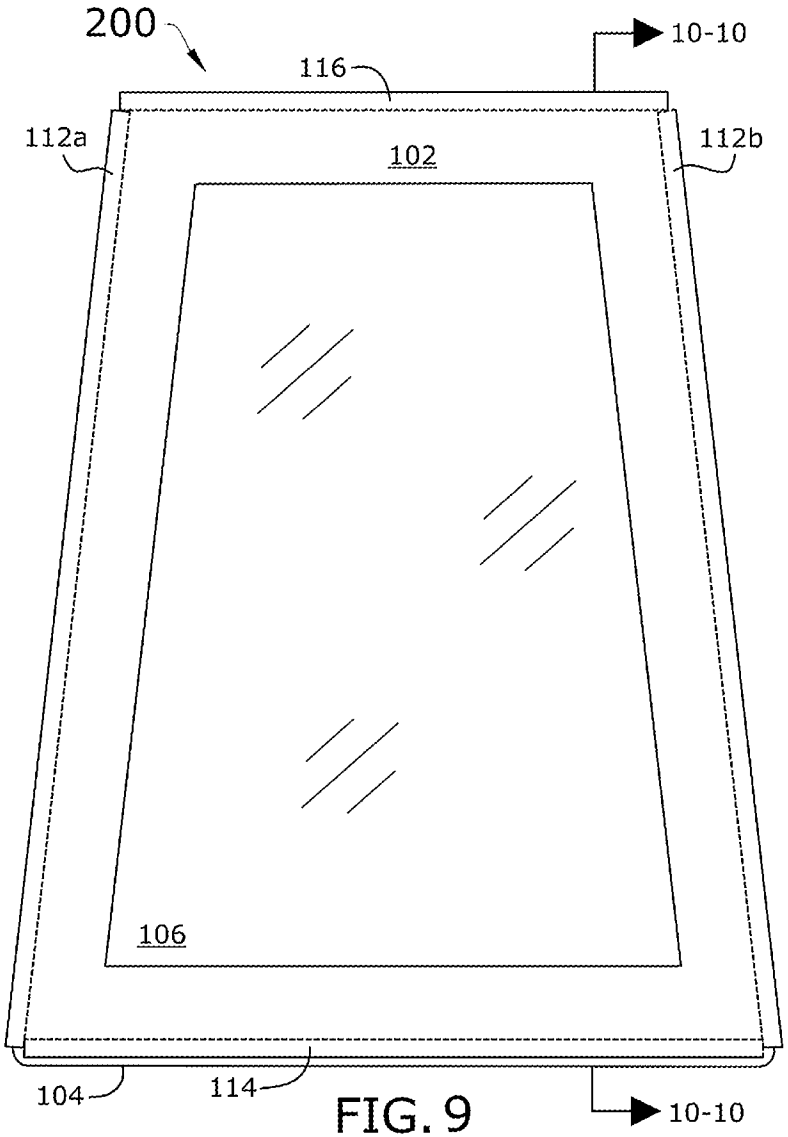
FIG. 9 conceptually illustrates a top view of a second embodiment of the makeup mixing plate and cover product with an indented flip edge.

Demonstrating at least a second embodiment of the makeup mixing plate and cover product, FIG. 9 conceptually illustrates a top view of a makeup mixing plate and cover product 200 with an indented flip edge. In some embodiments, the makeup plate lid includes an indented flip edge that curves under and around a metal rod that magnetically secures the makeup plate lid to the magnets at the makeup plate base when the makeup mixing plate and cover product 200 is in the closed position. As shown in this figure, the makeup mixing plate and cover product 200 has a trapezoid shape with two long-side edges 112*a* and 112*b* of equal length, an opening-side edge 114, and a bending-side (or back-side) edge 116. The makeup plate lid 102 in this example also shows the opening space in the middle covered by the glass 106 (e.g., plexiglass).

Figure 10:
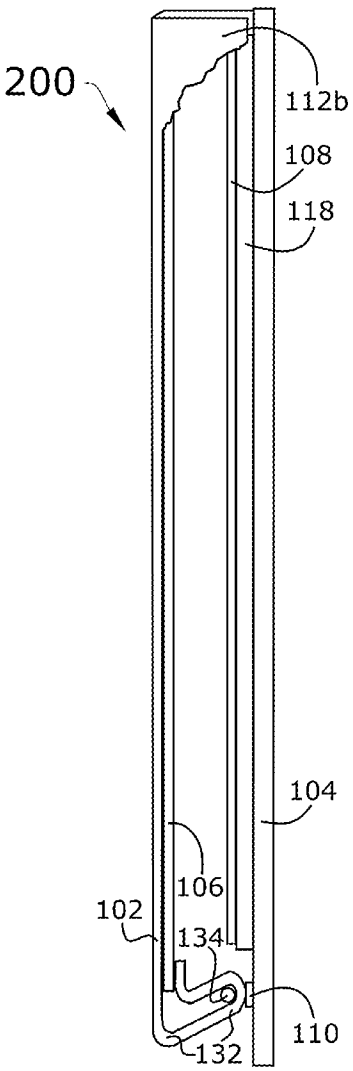
FIG. 10 conceptually illustrates a side sectional view, along lines 10-10 in FIG. 9, of the second embodiment of the makeup mixing plate and cover product with the indented flip edge.

Turning to FIG. 10, which conceptually illustrates a side sectional view, along lines 10-10 in FIG. 9, of the makeup mixing plate and cover product 200 with the indented flip edge. The makeup plate lid 102 includes the makeup plate lid 102, the makeup plate base 104, the glass 106, the makeup mixing plate 108, magnet(s) 110, a long side 112*b*, the plate support 118, an indented flip edge 132, and a metal rod 134. In some embodiments, the makeup mixing plate and cover product 200 with the indented flip edge comprises a plurality of magnets 110. In some embodiments, the makeup mixing plate and cover product 200 with the indented flip edge comprises only a single long rectangular magnet 110 positioned proximate to and running its long edge parallel to the opening-side edge 114. As shown in this figure, the indented flip edge 132 curves under and around the metal rod 134 which magnetically secures the makeup plate lid 102 to the magnets 110 at the makeup plate base 104 when the makeup mixing plate and cover product 200 is in the closed position. The indented flip edge 132 also curves around the metal rod 134 and up to the glass 106 to secure the glass 106 to the makeup plate 102 at the opening in the lid. The glass 106 attaches to the underside of the makeup plate lid 102 along edges of a curved portion of the indented flip edge of the makeup plate lid 102. The glass 106 may be any kind of rigid transparent material, such as tempered glass or plexiglass.

Figure 11:
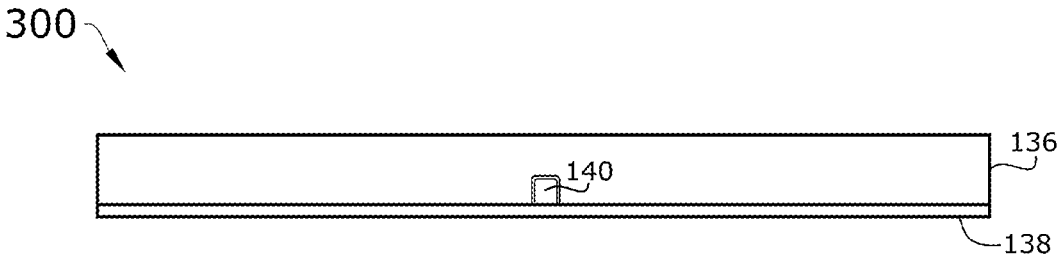
FIG. 11 conceptually illustrates a front view of a third embodiment of the makeup mixing plate and cover product with a lid release push button.

Demonstrating at least a third embodiment of the makeup mixing plate and cover product, FIG. 11 conceptually illustrates a front view of a makeup mixing plate and cover product 300 with a lid release push button. As shown in this figure, the third embodiment of the makeup mixing plate and cover product 300 comprises a makeup plate lid 136, a makeup plate base 138, and a lid release push button 140. To open the makeup plate lid 136 of the makeup mixing plate and cover product 300 in the third embodiment, the lid release push button is applied with pressure to push the button in, thereby releasing the makeup plate lid 136.

Figure 12:
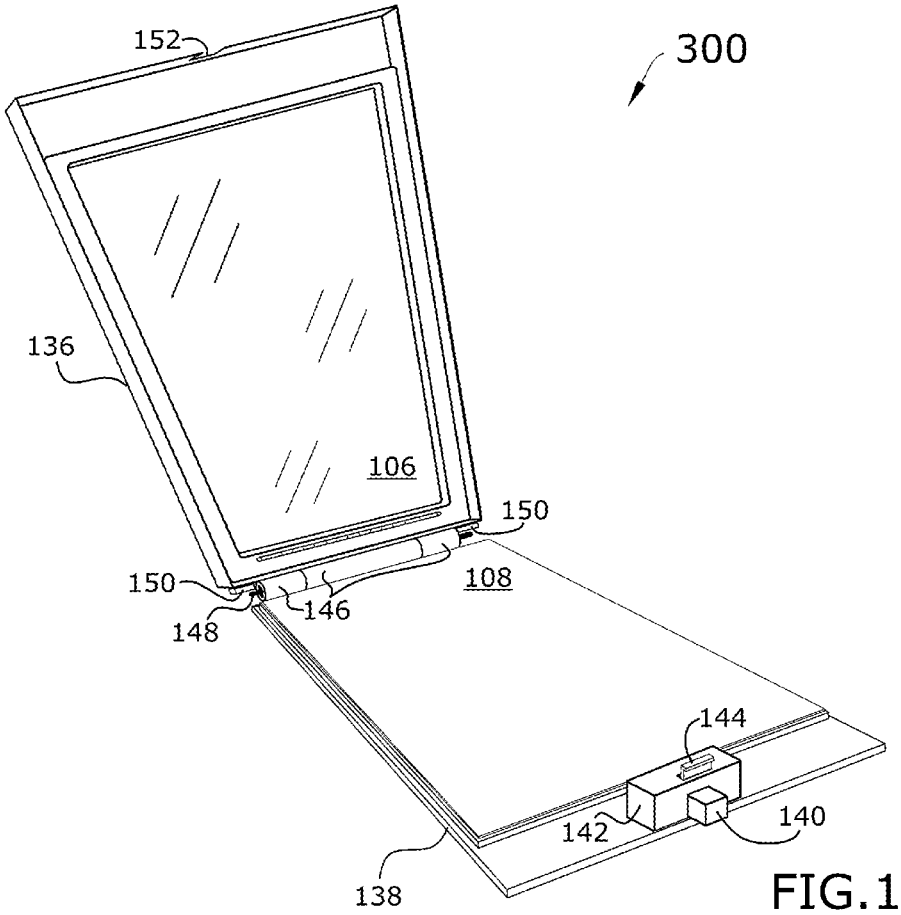
FIG. 12 conceptually illustrates a perspective view of the third embodiment of the makeup mixing plate and cover product with the lid release button in an open configuration.
Figure 14:
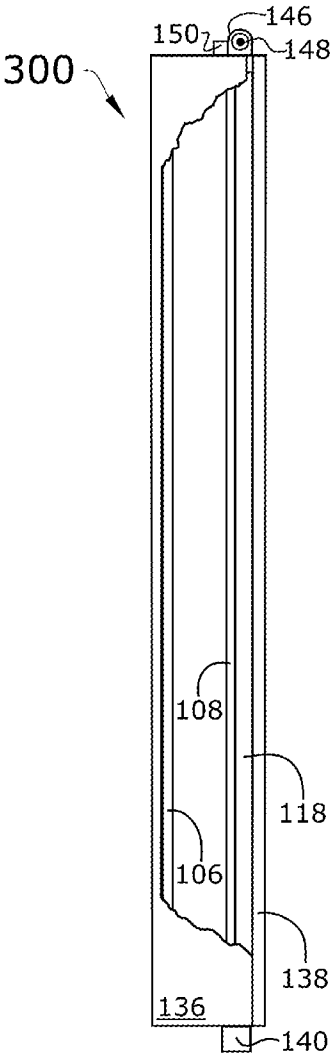
FIG. 14 conceptually illustrates a side sectional view, along lines 14-14 in FIG. 13, of the third embodiment of the makeup mixing plate and cover product with the lid release button.

Now turning to another example of the third embodiment of the makeup mixing plate and cover product, FIG. 12 conceptually illustrates a perspective view of the makeup mixing plate and cover product 300 with the lid release button in an open configuration. As shown in this figure, the third embodiment of the makeup mixing plate and cover product 300 comprises the glass 106, the makeup mixing plate 108, the makeup plate lid 136, the makeup plate base 138, the lid release push button 140, a lid release and lock box 142, a lid release and lock latch 144, a spring coil assembly 146, a coiling rod 148, an open position lid blocker 150, and a push button gap 152. When the makeup mixing plate and cover product 300 is set in the closed configuration, the push button gap 152 provides clearance for the lid release push button 140. The spring coil assembly 146 and the coiling rod 148 allow the makeup plate lid 136 to open in a circular manner, such that the edge of the makeup plate lid 136 with the push button gap 152 follows an arc of a semi-circle from the closed position to a fully open position, at which time the open position lid blocker 150 prevents the makeup plate lid 136 from swiveling further along the arc. In some embodiments, the open position lid blocker 150 makes contact with the makeup plate lid 136 to prevent opening the makeup plate lid 136 beyond the fully open position. In some embodiments, the fully open position is greater than 90 degrees and less than 180 degrees of a semi-circle.

Figure 13:
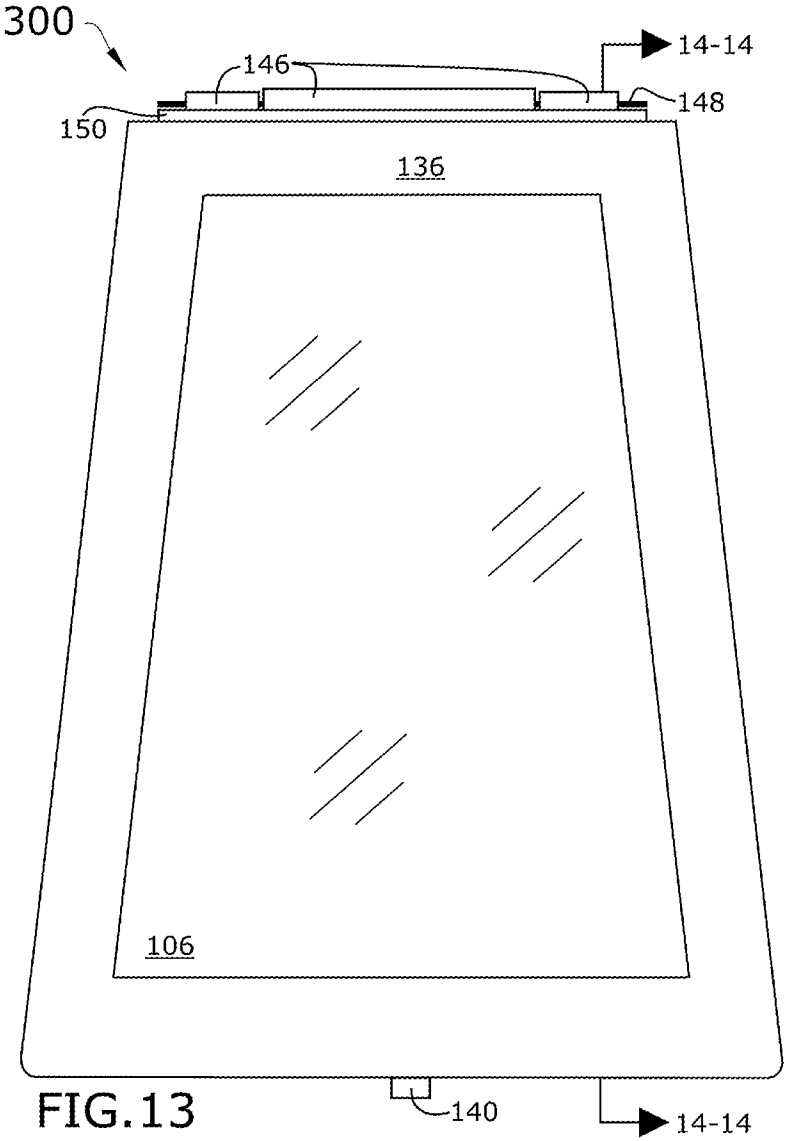
FIG. 13 conceptually illustrates a top view of the third embodiment of the makeup mixing plate and cover product with the lid release button.
Figure 15:
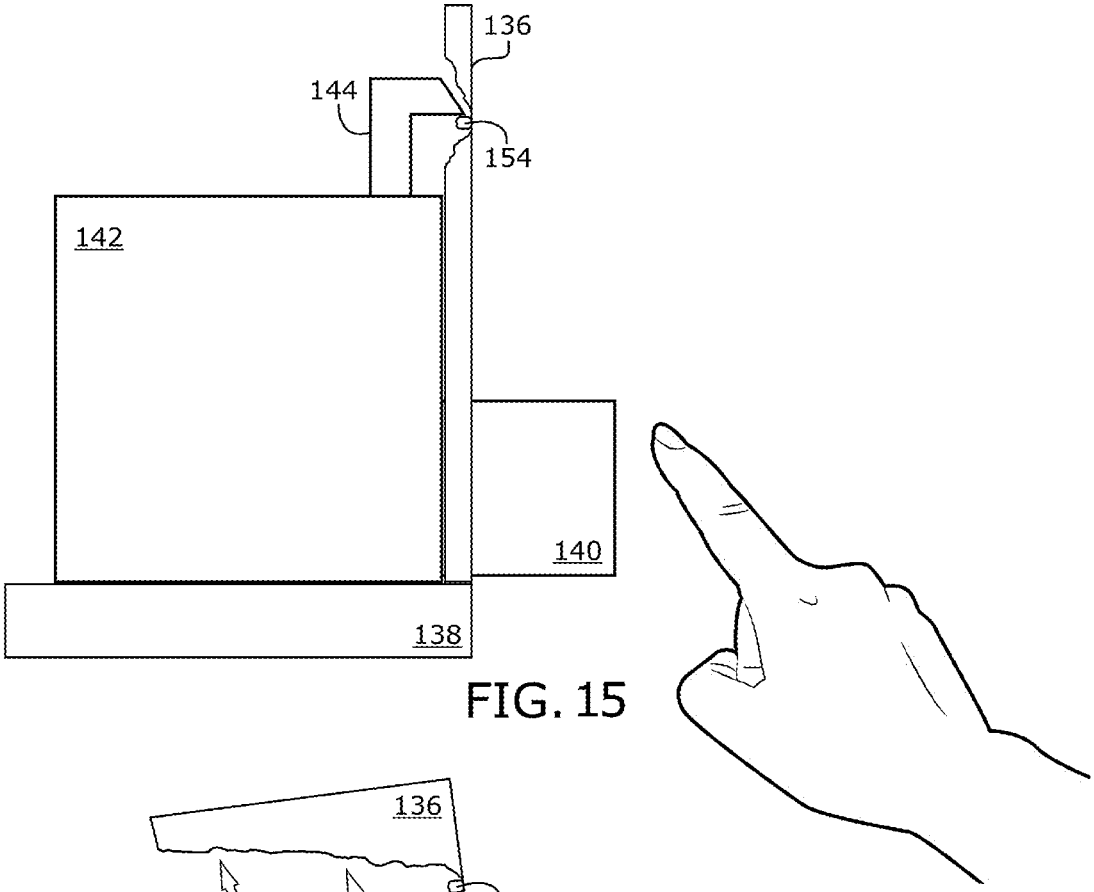
FIG. 15 conceptually illustrates a detailed view of the lid release button before pressure is applied to release the lid of the makeup mixing plate and cover product in the third embodiment.
Figure 16:
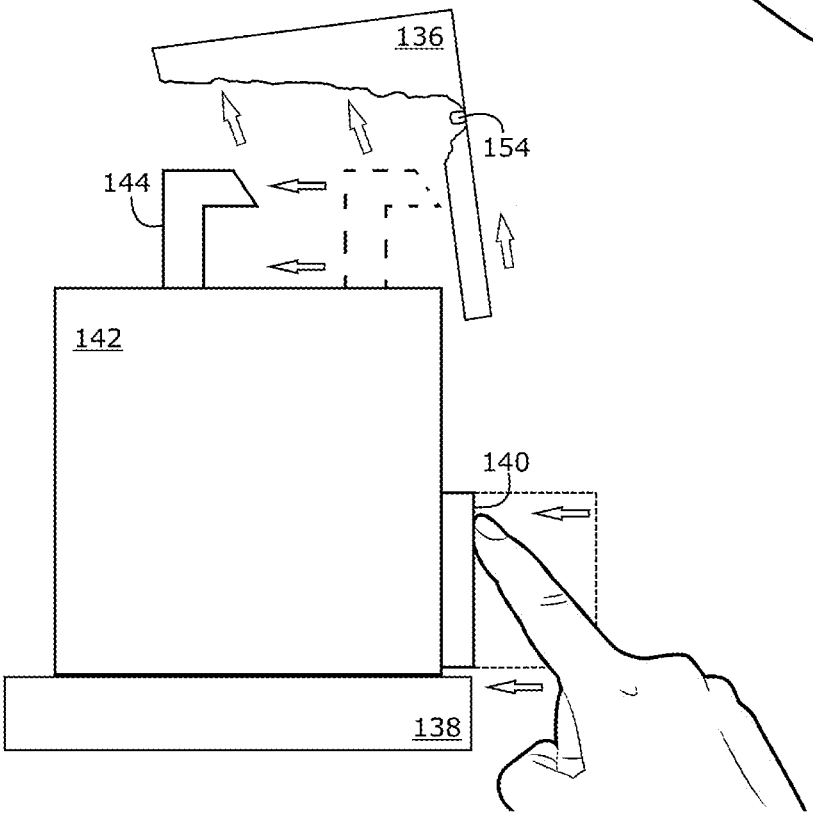
FIG. 16 conceptually illustrates another detailed view of the lid release button while pressure is applied to release the lid of the makeup mixing plate and cover product in the third embodiment.

The third embodiment of the makeup mixing plate and cover product 300 is demonstrated in FIG. 13 from another view. Specifically, FIG. 13 conceptually illustrates a top view of the third embodiment of the makeup mixing plate and cover product 300 with the lid release button. As shown in this figure, the third embodiment of the makeup mixing plate and cover product 300 includes the glass 106, the makeup plate lid 136, the lid release push button 140, the spring coil assembly 146, the coiling rod 148, and the open position lid blocker 150. Lines 14-14 provide a perspective of a sectional view of the makeup mixing plate and cover product 300, which is described next, by reference to FIG. 14, which conceptually illustrates a side sectional view, along lines 14-14 in FIG. 13, of the third embodiment of the makeup mixing plate and cover product 300 with the lid release button. As shown in this figure, the makeup mixing plate and cover product 300 includes the glass 106, the makeup mixing plate 108, the plate support 118, the makeup plate lid 136, the makeup plate base 138, the lid release push button 140, the spring coil assembly 146, the coiling rod 148, and the open position lid blocker 150.

The lid release push button 140 of the third embodiment of the makeup mixing plate and cover product 300 functions to release and secure the makeup plate lid 136 in accordance with the open and closed configurations of the makeup mixing plate and cover product 300. To operate as a mechanism to release and secure the makeup plate lid 136, the lid release push button 140 works in conjunction with several components. These components and their functions are shown by way of example in FIGS. 15 and 16. Specifically, FIG. 15 conceptually illustrates a detailed view of the lid release button 140 before pressure is applied to release the makeup plate lid 136 of the makeup mixing plate and cover product 300. Other components shown in this figure include the makeup plate base 138, the lid release and lock box 142, the lid release and lock latch 144, and a lid lock notch 154. As shown in this figure, when pressure is not applied to the lid release button 140, the lid lock notch 154 is positioned under the lock latch 144, which prevents the makeup plate lid 136 from being opened.

Now turning to an example the demonstrates the effect of pressure being applied to the lid release button 140. In particular, FIG. 16 conceptually illustrates a detailed view of the lid release button 140 while pressure is applied to release the makeup plate lid 136 of the makeup mixing plate and cover product 300. As shown in this figure, an exemplary finger is applying pressure to the lid release button 140. Enough force is being applied so that the lid release button 140 is depressed enough for the lid release and lock box 142 to cause the lid release and lock latch 144 to move back, away from the lid lock notch 154. When the lid lock notch 154 is disengaged from the lid release and lock latch 144, the makeup plate lid 136 can be moved freely along the semi-circle arc to open partially or fully (into the open configuration). In this way, one can ensure that the makeup plate lid 136 will remain closed when in a position with the lid lock notch 154 engaged with the lid release and lock latch 144, but can be easily opened by applying pressure to the lid release button 140.

Figure 17:
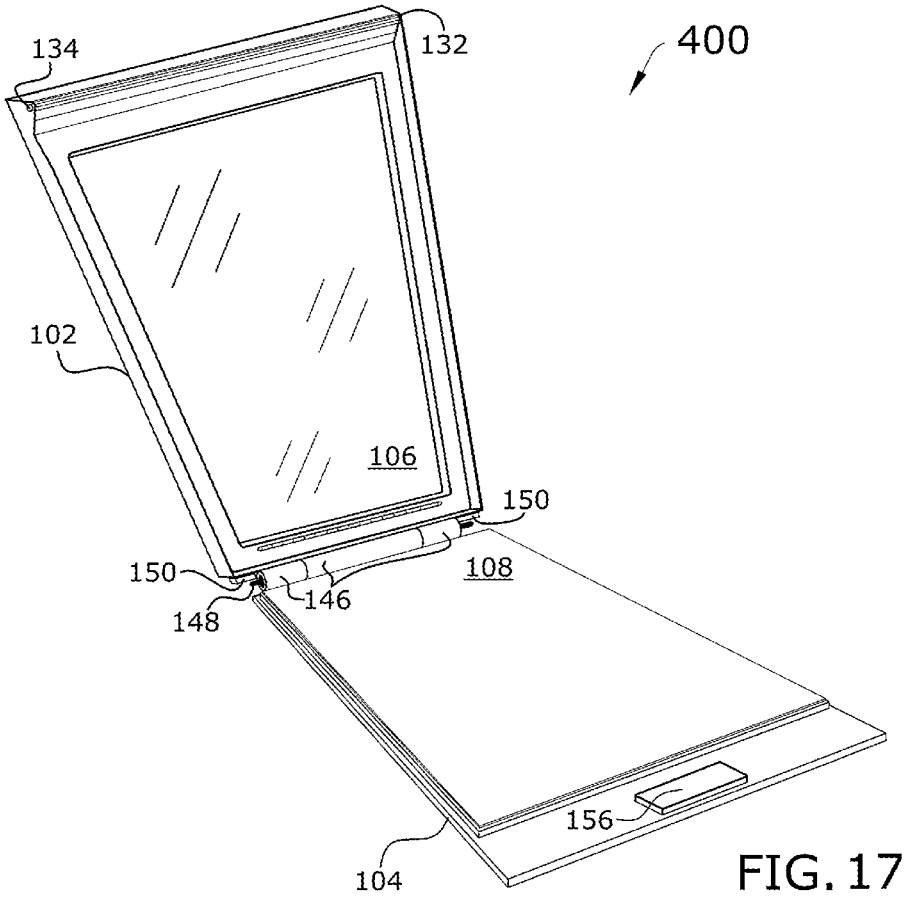
FIG. 17 conceptually illustrates a perspective view of a fourth embodiment of the makeup mixing plate and cover product in an open configuration with a single long lid-securing magnet.
Figure 18:
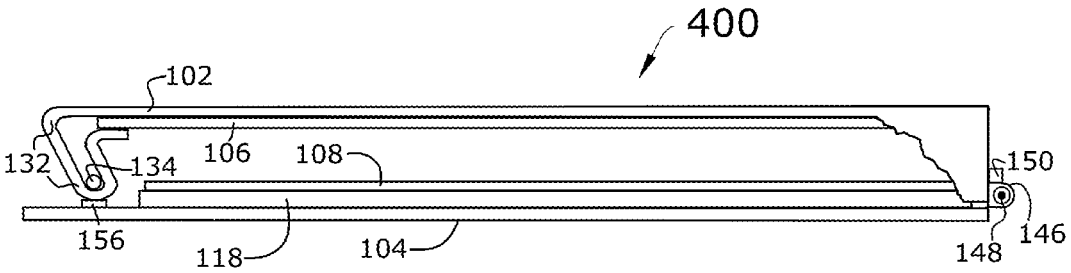
FIG. 18 conceptually illustrates a side sectional view of the fourth embodiment of the makeup mixing plate and cover product with the single long lid-securing magnet.

Now turning to another example of the makeup mixing plate and cover product, FIG. 17 conceptually illustrates a perspective view of a fourth embodiment of the makeup mixing plate and cover product 400 in an open configuration with a single long lid-securing magnet. As shown in this figure, the makeup mixing plate and cover product 400 includes a makeup plate lid 102, a makeup plate base 104, a glass 106, a makeup mixing plate 108, an indented flip edge 132, a metal rod 134 that is positioned within the indented flip edge 132, a spring coil assembly 146, a coiling rod 148, an open position lid blocker 150, and a single long lid-securing magnet 156. As demonstrated in FIG. 18, which conceptually illustrates a side sectional view of the fourth embodiment of the makeup mixing plate and cover product 400 with the single long lid-securing magnet 156, the metal rod 134 magnetically attracts to the single long lid-securing magnet 156 when the makeup mixing plate and cover product 400 is in the closed position. In some regards, the allows more convenience in comparison to other embodiments.

Figure 19:
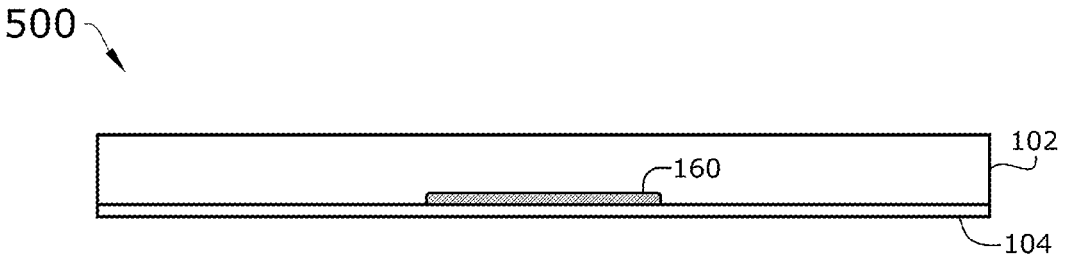
FIG. 19 conceptually illustrates a front view of a fifth embodiment of the makeup mixing plate and cover product with a thumb indentation at the front of the makeup plate lid for quick opening of the makeup mixing plate and cover product.
Figure 20:
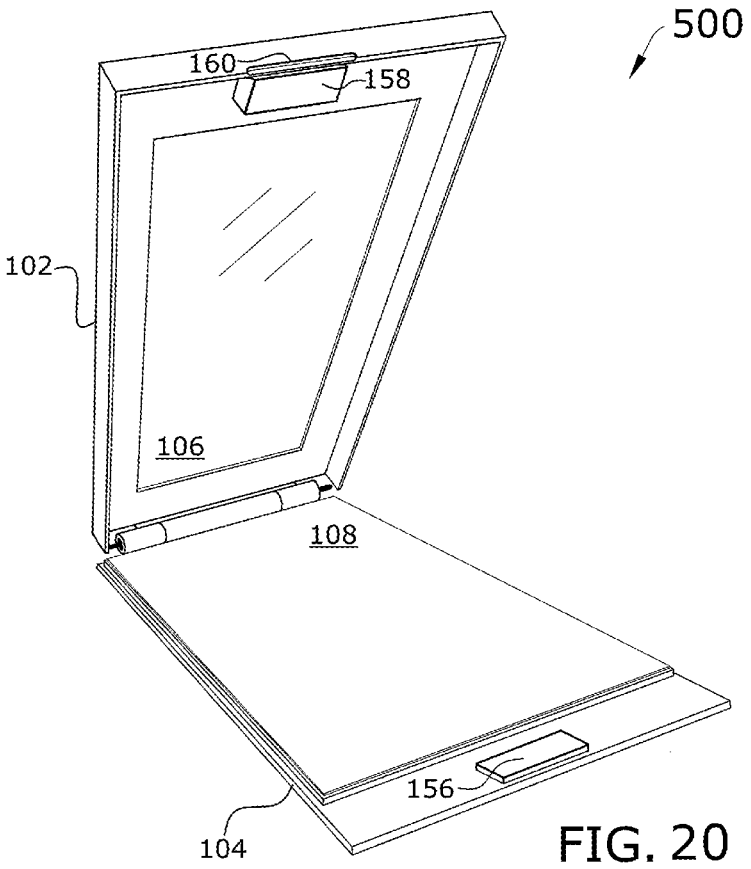
FIG. 20 conceptually illustrates a perspective view of the fifth embodiment of the makeup mixing plate and cover product in an open configuration with the thumb indentation and a pair of magnets.

Yet another makeup plate lid release mechanism is demonstrated by reference to FIGS. 19 and 20. In particular, FIG. 19 conceptually illustrates a front view of a fifth embodiment of a makeup mixing plate and cover product 500 with a thumb indentation 160 at the front of the makeup plate lid 102 for quick opening of the makeup mixing plate and cover product 500. As shown, the thumb indentation 160 is designed as a carve out of a portion of the makeup plate lid 102, and provides a slight separation between the makeup plate lid 102 and the makeup plate base 104, thereby allowing a makeup artist to quickly flip the makeup plate lid 102 by a thumb or finger.

Now turning to another example, FIG. 20 conceptually illustrates a perspective view of the fifth embodiment of the makeup mixing plate and cover product 500 in an open configuration with the thumb indentation 160 and a pair of magnets 156 and 158. Notably, the fifth embodiment of the makeup mixing plate and cover product 500, as shown in this figure, includes a first magnet 156 disposed on the makeup plate base 104 along the opening edge of the makeup mixing plate and cover product 500 and a second magnet 158 disposed at the underside of the makeup plate lid 102 along the opening edge of the makeup mixing plate and cover product 500. The two magnets 156 and 158 provide ample strength to keep the makeup mixing plate and cover product 500 closed when in the closed configuration, but not so much resistance when a makeup artist opens the makeup plate lid 102 by a thumb or finger applied to the thumb indentation 160.

The embodiments described herein, by reference to FIGS. 1-18, are only intended as exemplary and not intended to limit understanding of the makeup mixing plate and cover product in other embodiments and with various adaptations. For instance, various relative angles of the corners of the base are conceived as proper and essentially provide the same benefits as described in this document. Furthermore, persons of ordinary skill in the art may appreciate that numerous design configurations may be possible to enjoy the functional benefits of the inventive articles. Thus, given the wide variety of configurations and arrangements of embodiments of the present invention the scope of the invention is reflected by the breadth of the claims below rather than narrowed by the embodiments described above.

I claim:

1. A handheld makeup mixing plate and cover product comprising:

a makeup plate base formed in a trapezoid shape by an opening side edge, a spring coil side edge that is shorter in length than the opening side edge, and two side edges of equal length, the makeup plate base comprising an interior makeup plate base side and an exterior makeup plate base side, wherein said trapezoid shaped makeup plate base is configured to be ergonomically held in a first hand of a user along the exterior makeup plate base side;

a trapezoid shaped cardboard support plate that is disposed atop the interior makeup plate base side of the trapezoid shaped makeup plate base;

a trapezoid shaped steel makeup mixing plate on which makeup and cosmetic materials are placed, mixed, and maintained, wherein a second hand of the user works with makeup and cosmetic materials while the trapezoid shaped makeup plate base is held in the first hand of the user, wherein the trapezoid shaped steel makeup mixing plate is configured to provide a flat surface to mix different makeup and cosmetic materials into a makeup and cosmetic mixture, wherein the trapezoid shaped steel makeup mixing plate is disposed atop the trapezoid shaped cardboard support plate at a raised elevation above the trapezoid shaped makeup plate base;

a trapezoid shaped makeup plate lid that is configured to cover the trapezoid shaped makeup mixing plate in a closed configuration and expose the steel makeup mixing plate and any makeup and cosmetic materials placed and mixed on the steel makeup mixing plate in an open configuration, said trapezoid shaped makeup plate lid comprising a trapezoid shaped middle open cutout space, an exterior top side with the trapezoid shaped middle open cutout space, and an interior under side with the trapezoid shaped middle open cutout space, wherein, when the trapezoid shaped makeup plate lid covers the trapezoid shaped makeup mixing plate in the closed configuration, the trapezoid shaped middle open cutout space provides visibility through the trapezoid shaped makeup plate lid for visual inspection of makeup and cosmetic materials placed and mixed on the steel makeup mixing plate;

a clear cover window that is disposed along the interior under side of the trapezoid shaped makeup plate lid and positioned to cover the trapezoid shaped middle open cutout space to allow protected visual inspection through the trapezoid shaped middle open cutout space when the trapezoid shaped makeup plate lid is in the closed configuration; and a spring coil assembly that attaches to the makeup plate base along the spring coil side edge and connects the trapezoid shaped makeup plate base to the trapezoid shaped makeup plate lid to provide a freedom of movement to open and close the trapezoid shaped makeup plate lid along the opening side edge of the trapezoid shaped makeup plate base, wherein the spring coil assembly limits opening and closing movements of the trapezoid shaped makeup plate lid between (i) the closed configuration that covers the trapezoid shaped steel makeup mixing plate and limits exposure of the trapezoid shaped steel makeup mixing plate and any makeup and cosmetic materials and the makeup and cosmetic mixture placed on the flat surface of the trapezoid shaped steel makeup mixing plate to visual inspection by the user and (ii) the open configuration that fully exposes the trapezoid shaped steel makeup mixing plate and any makeup and cosmetic materials and the makeup and cosmetic mixture placed on the flat surface of the trapezoid shaped steel makeup mixing plate for both visual inspection and physical access by the user.

2. The handheld makeup mixing plate and cover product of claim 1 further comprising a plurality of magnets which secure a connection between the trapezoid shaped makeup plate lid and the trapezoid shaped makeup plate base while in the closed configuration and which are disconnected from each other by forcible upward movement that separates the trapezoid shaped makeup plate lid away from the trapezoid shaped makeup plate base along the opening side edge.

3. The handheld makeup mixing plate and cover product of claim 2, wherein the trapezoid shaped makeup plate base and the trapezoid shaped makeup plate lid are configured for a single hand of the user to ergonomically hold along the two side edges of the trapezoid shaped makeup plate base, wherein the plurality of magnets comprise a first magnet that is disposed on the interior makeup plate base side of the trapezoid shaped makeup plate base approximately along the opening side edge and a second magnet that is disposed on the interior under side of the trapezoid shaped makeup plate lid approximately along the opening side edge.

4. The handheld makeup mixing plate and cover product of claim 2, wherein the plurality of magnets comprise four magnets, wherein the four magnets include a first set of two magnets disposed proximate to opposing lower corners of the trapezoid shaped makeup plate base along opening side edge of the trapezoid shaped makeup mixing plate and a second set of two magnets disposed proximate to opposing upper corners of the trapezoid shaped makeup plate lid along the opening side edge of the trapezoid shaped makeup mixing plate.

5. The handheld makeup mixing plate and cover product of claim 1 further comprising a single long magnet attached to the trapezoid shaped makeup plate base along the opening side edge and a metal rod connected to the trapezoid shaped makeup plate lid along the opening side edge, wherein the metal rod magnetically attracts to the single long magnet to secure an opening side edge connection between the trapezoid shaped makeup plate lid and the trapezoid shaped makeup plate base while in the closed configuration, wherein the opening side edge connection is disconnected by forcible upward movement of the trapezoid shaped makeup plate lid away from the trapezoid shaped makeup plate base along the opening side edge.

6. The handheld makeup mixing plate and cover product of claim 5 further comprising an indented flip edge of the trapezoid shaped makeup plate lid for quick opening of the trapezoid shaped makeup plate lid by a finger of the user applying forcible upward movement along the opening side edge to the indented flip edge of the trapezoid shaped makeup plate lid by the finger and away from the trapezoid shaped makeup plate base.

7. The handheld makeup mixing plate and cover product of claim 1 further comprising a lid release button, a lid release and lock box, a lid release and lock latch, a lid lock notch along an inner surface of the trapezoid shaped makeup plate lid, and a push button gap along the opening side edge of the trapezoid shaped makeup plate lid, wherein the lid release and lock box is attached to the trapezoid shaped makeup plate base along the opening side edge, wherein the push button gap provides clearance for the lid release button, wherein the lid release button and the lid release and lock latch are operatively connected together within the lid release and lock box, wherein the lid lock notch secures the lid release and lock latch to maintain the closed configuration of the trapezoid shaped makeup plate lid until pressure is applied to the lid release button.

8. The handheld makeup mixing plate and cover product of claim 7, wherein the lid release button secures a connection between the trapezoid shaped makeup plate lid and the trapezoid shaped makeup plate base when the lid release button is not depressed and the lid release and lock latch is latched to the lid lock notch, wherein the spring coil assembly comprises a coiling rod, wherein the spring coil assembly externally connects along the spring coil assembly side edge to the trapezoid shaped makeup plate base and the trapezoid shaped makeup plate lid, wherein the spring coil assembly is rotatably engaged to apply circular spring force that swivels the trapezoid shaped makeup plate lid open to a particular angular displacement when the lid release and lock latch is unlatched from the lid lock notch by pressure applied to depress the lid release button, wherein the spring coil assembly comprises an open configuration lid block that prevents the trapezoid shaped makeup plate lid from opening beyond the particular angular displacement from a position of the trapezoid shaped makeup plate lid with respect to the trapezoid shaped makeup plate base in the closed configuration.

9. The handheld makeup mixing plate and cover product of claim 3, wherein the spring coil assembly externally connects along the spring coil assembly side edge to the trapezoid shaped makeup plate base and the trapezoid shaped makeup plate lid.

10. The handheld makeup mixing plate and cover product of claim 9, wherein the spring coil assembly comprises a coiling rod and an open configuration lid block that prevents the trapezoid shaped makeup plate lid from opening beyond a particular angular displacement from a position of the trapezoid shaped makeup plate lid with respect to the trapezoid shaped makeup plate base in the closed configuration.

* * * * *